US009309085B2

(12) United States Patent
Barea

(10) Patent No.: US 9,309,085 B2
(45) Date of Patent: Apr. 12, 2016

(54) METHOD AND DEVICE FOR FEEDING A THREAD TO A TEXTILE MACHINE WITH CONSTANT TENSION AND CONSTANT VELOCITY OR QUANTITY

(75) Inventor: Tiziano Barea, Busto Arsizio (IT)

(73) Assignee: BTSR INTERNATIONAL S.P.A., Olgiate Olona (Varese) (IT)

( * ) Notice: Subject to any disclaimer, the term of this patent is extended or adjusted under 35 U.S.C. 154(b) by 359 days.

(21) Appl. No.: 14/118,174

(22) PCT Filed: May 30, 2012

(86) PCT No.: PCT/IB2012/001053

§ 371 (c)(1), (2), (4) Date: Nov. 15, 2013

(87) PCT Pub. No.: WO2013/045982

PCT Pub. Date: Apr. 4, 2013

(65) Prior Publication Data

US 2014/0084101 A1 Mar. 27, 2014

(30) Foreign Application Priority Data

Jun. 8, 2011 (IT) ..... MI2011A1027

(51) Int. Cl.
*B65H 59/38* (2006.01)
*B65H 59/06* (2006.01)
*B65H 59/18* (2006.01)

(52) U.S. Cl.
CPC ..... *B65H 59/388* (2013.01); *B65H 59/06* (2013.01); *B65H 59/18* (2013.01); *B65H 2701/31* (2013.01); *B65H 2701/319* (2013.01)

(58) Field of Classification Search
CPC ..... B65H 59/388; B65H 59/38; B65H 59/18; B65H 59/06; B65H 59/02
See application file for complete search history.

(56) References Cited

U.S. PATENT DOCUMENTS 5,035,372 A 7/1991 Siebertz
6,676,054 B2 1/2004 Heaney et al.
(Continued)

FOREIGN PATENT DOCUMENTS

CN 85105438 A 1/1987
CN 2423259 Y 3/2001
CN 1639401 A 7/2005
(Continued)

OTHER PUBLICATIONS

International Search Report mailed Sep. 21, 2012 for PCT/IB2012/001053 to BTSR International S.P.A. Filing Date May 30, 2012.
(Continued)

*Primary Examiner* — William E Dondero
(74) *Attorney, Agent, or Firm* — Vorys, Sater, Seymour and Pease LLP

(57) ABSTRACT

A method for feeding a yarn with constant tension and constant velocity or quantity to a textile machine the processing point of which is distant from a spool from which the yarn unwinds. A first feed control and regulator loop provided presenting first tension measurer and regulator for the yarn. Velocity measurer forming part of a second control loop is provided in proximity to the point or zone to measure this velocity. The yarn feed tension is regulated on the basis of the measured velocity datum to achieve a desired prefixed velocity value at the processing zone or point.

15 Claims, 1 Drawing Sheet

(56) References Cited

U.S. PATENT DOCUMENTS

| | | | |
|---|---|---|---|
| 2008/0210804 | A1 | 9/2008 | Barea |
| 2009/0178757 | A1 | 7/2009 | Cocovi et al. |

FOREIGN PATENT DOCUMENTS

| | | | |
|---|---|---|---|
| EP | 0380913 | A2 | 8/1990 |
| EP | 0489307 | A1 | 6/1992 |
| EP | 1901984 | | 3/2008 |
| WO | 2007006411 | A1 | 1/2007 |

OTHER PUBLICATIONS

Chinese Office Action dated Jun. 3, 2015,comments and search report, in corresponding Chinese patent application No. 201280028307.1.

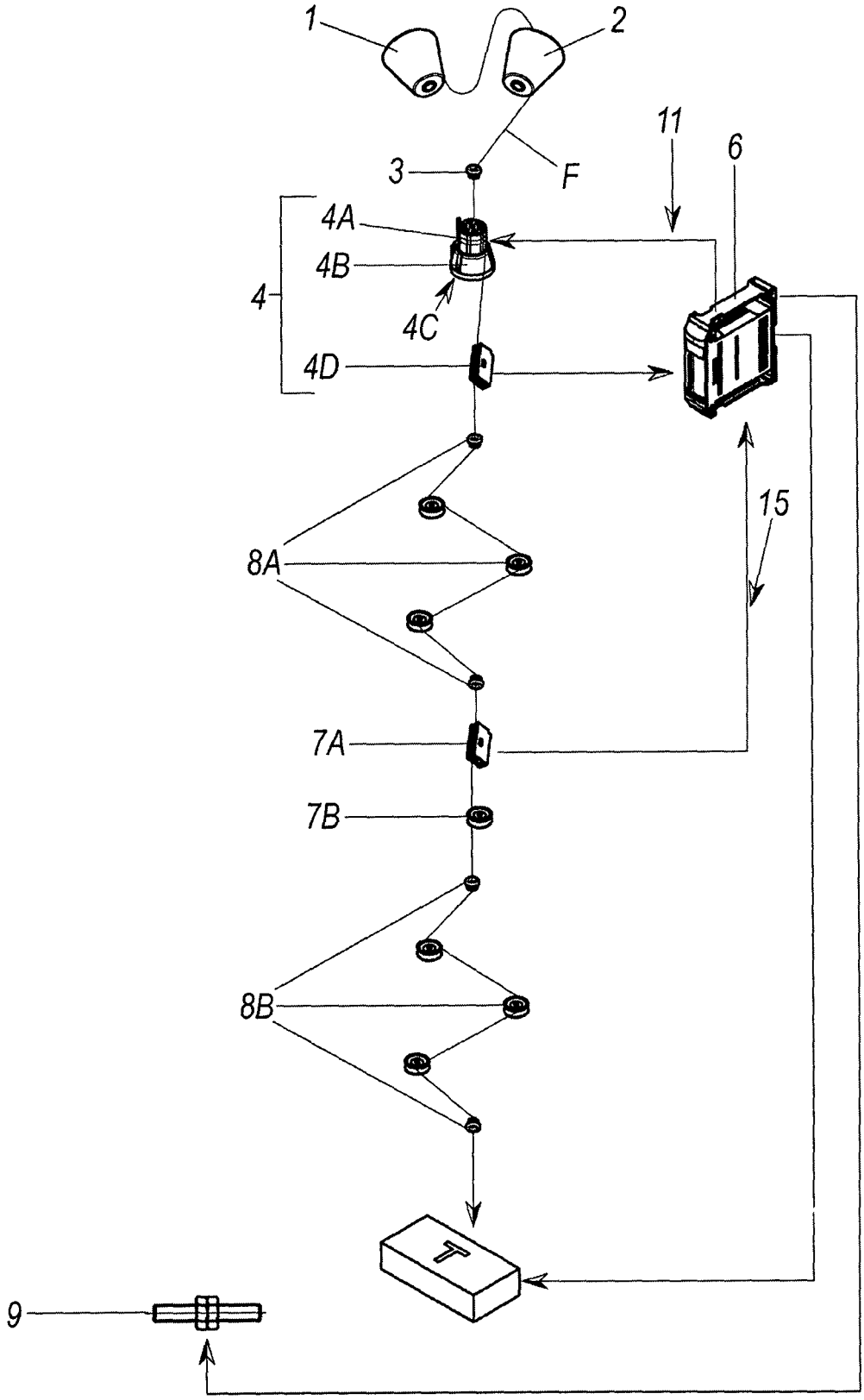
1
2
11
6
3
F
4A
4B
4
4C
4D
15
8A
7A
7B
8B
9

METHOD AND DEVICE FOR FEEDING A THREAD TO A TEXTILE MACHINE WITH CONSTANT TENSION AND CONSTANT VELOCITY OR QUANTITY

CROSS-REFERENCE TO RELATED APPLICATIONS

This is a §371 National Stage Application of International Application No. PCT/IB2012/001053 filed on 30 May 2012, claiming the priority of Italian Patent Application No. MI2011A001027 filed on 8 Jun. 2011.

The present invention relates to a method and a device for feeding a yarn to a textile machine which mutually combines automatically the benefits of constant tension feed (simplicity of handling and no need for interfacing with the machine) with the benefits of constant velocity feed (constant fed yarn quantity, hence high quality and control of any velocity irregularity during the process) in accordance with the introduction to the main claim.

As is well known, a yarn used by a textile machine to produce an article must preferably be fed to the machine with constant tension or velocity to enable production to take place without defects.

Such feed is achieved by known devices commonly used to ensure the quality of a textile production process; this is obtained by virtue of their ability to ensure in real time a yarn feed to a textile machine for example at constant velocity, hence ensuring feed with constant yarn quantity.

This type of feed is however possibly only by feeding the yarn by rolling takeoff, a technique involving rotation of the spool with consequent impossibility of connecting two spools together by the known head-tail method. This technique hence does not enable the machine to operate without interruption, necessary to replace the empty spool with a new spool.

A constant velocity feed system by over-end takeoff evidently would enable several spools to be connected together by the head-tail method, which would in any event be unusable because as the yarn has an inherent elasticity, its unwinding between a full and empty spool would result in yarn elongation to an extent depending on its unwinding tension; consequently a constant velocity/quantity feed would be extremely variable (in terms of yarn quantity fed), with fed yarn quantity variations depending on the tension under which the yarn is unwound from the spool.

This type of feed also has the limit of necessary interfacing with the machine: in this respect, the control unit must at every moment know the collection or utilization rate by the machine in order to adapt the set point of the rotary member in proximity to the spool or bobbin to the collection rate itself (at the processing point or zone) according to the required stretch ratio. The system must therefore work in electrical symmetry with the machine.

U.S. Pat. No. 6,676,054 describes a method for unwinding a yarn from a spool by the over-end takeoff method with head-tail modalities. This is achieved by positioning the spool from which each yarn unwinds in a particular manner relative to a corresponding yarn guide member such as to determine optimal angles and distances with the object of reducing the yarn unwinding tension changes between the full and empty spool and the consequent variations in the friction generated by contact with the thread guide at the ceramic or passage points. However, said patent does not describe any problem relative to the velocity and tension change which said yarn undergoes due to the distance between the spool and the process insertion zone or point of the textile machine to which the yarn is fed, neither does it suggest any yarn control solution which enables the velocity and tension of the yarn entering the machine production zone to be maintained constant, in particular a machine for sanitary napkin production.

EP-489307 describes a method for controlling the quantity of at least one yarn fed to a textile machine on that yarn. It comprises: a first stage or self-learning stage, in which a sample article is produced, the data relative to the operative characteristics of the machine and to the yarn quantity fed to it during this first stage being memorized; and at least one second stage in which articles corresponding to that sample are produced. During this second stage, the data relative to the production of these articles (i.e. the machine operative data and the yarn quantity fed for this production) are compared with the memorized data, then on the basis of this comparison the yarn feed means are controlled such as to maintain said quantity constant during the entire production process.

This method is implemented by interfacing a control unit for the production process with the textile machine such that the yarn feed velocity is always in the desired ratio with the rate of yarn absorption by the textile machine.

Said solution and other similar solutions do not provide precise control of the yarn velocity after its unwinding from the corresponding spool and before its entry into the machine, but merely provide constant "stretch", i.e. ratio between the machine absorption rate (or collection rate) and the yarn feed velocity.

This solution is also unsuitable for processing a yarn by a continuous process, but only and exclusively by discontinuous processes, hence characterised by comprising a repetition of equal cycles such as those on circular machines (small-medium diameter).

Other solutions are also known tending to reduce to a minimum the friction undergone by the yarn during its feed to the textile machine by carefully "physically" positioning the spools at the textile machine. However these solutions do not provide real control of the yarn feed velocity (and tension) to the textile machine.

EP1901984 in the name of the present Applicant describes a method for feeding a yarn at constant tension to a processing point of a textile machine (such as a sanitary napkin production machine) distant from the spool or equivalent support member from which the yarn unwinds. The yarn tension is controlled in proximity to the spool by measuring the yarn tension and controlling and regulating this parameter at a first predetermined tension value at the commencement of its use by the textile machine immediately after unwinding the yarn from the spool. Second tension measurement means are positioned in proximity to the textile machine to achieve control of this parameter, which is used to regulate the yarn tension in proximity to the spool; in this manner a desired tension is obtained at the machine by modifying the first tension value during the use of the textile machine. This is achieved by comparing the yarn tension measured at the inlet of this latter and a second predetermined tension value, said comparison being such as to maintain said measured tension value constantly equal to said second predetermined value for the entire duration of machine utilization.

Said patent text relative to this known solution describes a method and corresponding device for solving the problem of making a set yarn tension value uniform in proximity to the second measurement means, but is unable to compensate for different friction values subsequent to these tension measurement means, such different friction values being due for example to the use of a glue applicator on sanitary napkin production machines or to thread guides of a circular machine. The friction differences downstream of the machine could hence produce a tension increase with consequent yarn stretching (particularly evident with elastic yarns) It follows that in a plurality of yarns on which a textile machine operates, these could all have the same tension, but be fed with different velocities (the yarn is more stretched the higher the friction tension not compensated by the system is because it is generated downstream of the second tension sensor) to the machine, with consequent worsening of the final quality of the finished product.

Nothing in the said patent text under examination suggests controlling the velocity of the yarns entering the machine nor suggests a precise control of the consumption of each yarn fed (i.e. control of the yarn quantity reaching the machine).

US 2009/178757 describes a method for controlling the tension with which a reinforcement thread or cable used to prepare tyres is wound onto a form. This text states that the cable or thread can be single filament or multi-filament and can be of various kinds, such as textile or metal.

This prior document describes a method comprising a stage during which the thread is wound about the form, the thread tension being controlled and managed during winding. This control and management is implemented by a compensation ring, the length of which is varied against the action of a spring.

US 2009/178757 describes a velocity control able to maintain the tension constant.

Moreover, this prior patent neither describes nor suggests maintaining constant velocity by controlling and regulating a yarn tension value, so that the measured velocity be maintained uniform at a prefixed value.

An object of the present invention is therefore to provide a method and relative device which enable the aforesaid limits of the known methods for feeding yarn to a textile machine to be overcome.

Another object is to provide a method and device of the aforesaid type enabling a yarn to be fed securely by combining the advantages of constant tension feed with the advantages of constant velocity feed, hence overcoming the individual limits of the two solutions, in particular when the distance between the textile machine and the spool from which the yarn is unwound is large (for example it can be less than 1 metre but can also be some tens of metres).

Another object is to provide a method and device enabling the yarn consumption (i.e. the yarn quantity fed to the operator machine) to be controlled with precision, by enabling the provision of a plurality of regulator loops for yarn characteristics, i.e. its tension and velocity, to hence achieve yarn feed at uniform tension and constant feed velocity, and therefore ensure production of articles with perfectly constant yarn quantity, hence at known, calculable, and guaranteed costs.

A further object is to provide a method and device of the aforesaid type enabling the stretch (i.e. ratio of machine collection rate to fed yarn velocity) to be programmed, to hence control with certainty the yarn quantity required for each article produced.

A further object is to provide a method and corresponding device which can be implemented and operated without any need for synchronization with the textile machine, so as to be implementable and installable even on machines already in production and/or installed and without any prearrangement.

These and other objects which will be apparent to the expert of the art are attained by a method and device in accordance with the accompanying claims.

The present invention will be more apparent from the accompanying drawing, which is provided by way of non-limiting example and in which:

FIG. 1 shows schematically a device in accordance with the present invention.

With reference to said FIG. 1, a device of the invention is usable for controlling the feed of a yarn F to a textile machine T, for example a sanitary napkin production machine, i.e. a textile machine in which each spool, from which a corresponding yarn processed by the machine is unwound, is positioned at a distance which can vary from less than one metre to some tens of metres.

In the example, the yarn F is unwound from a spool 2 connected in known head-tail manner to another spool 1. This enables continuous yarn processing by the textile machine T by avoiding stoppage when the spool 2 is empty. The yarn is unwound in over-end takeoff manner.

After removal from the spool 2, the yarn F passes through a usual thread guide 3.

The yarn F then cooperates with an apparatus 4 for measuring and regulating the tension with which it is fed to the machine T.

This known apparatus 4 comprises in the example shown in the figure a rotary element 4A on which the yarn F is wound (the yarn is at least partially wound on this element or undergoes a number of turns on it); the rotary element is driven by its own actuator or electric motor 4B, for example of brushless type. A usual velocity sensor 4C such as a Hall sensor, an encoder or the like (preferably integrated into the motor), cooperates with this member. The apparatus 4 is also provided with a tension sensor 4D, able to measure in real time and with absolute accuracy the tension of the yarn F during the feed stage.

The components 4B, 4C and 4D of the apparatus 4 are connected to a control circuit or unit preferably of microprocessor type 6 which, based on the tension datum measured by the sensor 4D and using a predetermined control algorithm (for example PID), compares each measured datum with prefixed homogeneous data (defining a "SETPOINT1_TENSION") and if a difference exists between said data it intervenes on the member 4A (in particular on the said electric motor 4B) such that this latter brakes or accelerates to make the yarn feed tension measured by the sensor 4D uniform with the memorized tension values.

The members 4A and 4B, the sensors 4C and 4D and the unit 6 together define for the feed tension of the yarn F a first measurement and regulator loop 11 having very rapid intervention times. In this respect, the first regulator loop has to intervene immediately as soon as the sensor 4D senses an undesired variation in the tension of the yarn F, such a variation in any event being generated naturally during yarn unwinding from the spool 2, for example deriving from the advancement of the spool unloading.

In textile machines of the aforesaid type operating on a plurality of yarns, each of these latter is preferably guided by the corresponding spool to the machine by using a plurality of thread guide members 8A which by interacting with the yarn modify its movement trajectory and its spatial angulation. This interaction creates friction which can modify to a greater or lesser extent the yarn tension between the spool and the machine, which can reflect negatively on the article produced by the machine.

This drawback is overcome by the device of the invention which includes the presence of a second regulator loop for the tension and velocity of the yarn F. This device comprises a second tension sensor 7A and a velocity sensor 7B (possibly integrated into the interior of the tension sensor or external to it) positioned at a distance from the first sensor 4D and in particular positioned in proximity to the zone in which the yarn F is withdrawn by usual withdrawal members (not shown) of the textile machine for its processing.

In a simplified form, this apparatus 7B can be a simple wheel rotatable about a pin and associated with a counter for the number of effected turns or turn fractions, or a velocity sensor. The sensor can be outside or inside the wheel.

The second sensors 7A and 7B are also connected to the control circuit or unit 6 (acting on the rotary member 4A or rather on its motor 4B) to define with this latter the second regulator loop 15 for the tension and/or velocity of the yarn F.

The control unit 6 operates on the basis of prefixed tension and/or velocity values defined respectively as SETPOINT2_TENSION and SETPOINT3_VELOCITY, depending on whether the system operates respectively at constant tension or at constant velocity and tension.

In its first and most simple embodiment, the system operates exactly as described in EP1901984 with the only difference that the control unit 6 not only ensures constant tension (SETPOINT2_TENSION) of the yarn F in proximity to the textile machine T but also, by means of the velocity sensor 7B, continues to verify that the yarn velocity in proximity to the machine lies within a programmable set range defined for example as a percentage of the SETPOINT3_VELOCITY; if this velocity lies outside said range for a programmable determined time, the unit 6 generates a warning or an error and possibly halts the textile machine T.

This velocity range can be fixed or, if several feed devices are connected to the control unit 6 (such as to define a control system for the feed of several yarns to the machine), can be the resultant of the average of the velocities read by the unit associated with each sensor 7B cooperating with each fed yarn (each device obviously has its own velocity sensor) or be different from position to position.

If the device is integrated into the machine and hence receives from it the value of the collection rate, from which to directly or indirectly obtain the value of the SETPOINT3_VELOCITY by suitable interfacing (serial line, encoder, proximity sensor, . . . ), the control range for generating the warning or alarm signal could be determined in absolute manner.

In a second possible embodiment, the device combines the simplicity of constant tension feed with the benefits of constant velocity feed by closing the second control loop 15 on velocity.

Hence the device commences by operating in constant tension mode exactly as described in EP1901984, then while continuing to monitor the velocity of the individual yarns can decide to activate the control loop 15, in order to make uniform not the tension in proximity to the machine T at the SETPOINT2_TENSION, but instead the velocity of said yarns at a SETPOINT3_VELOCITY.

This control loop could either be always active or be automatically activated when the control unit 6 realizes that the velocity of the fed yarn or yarns is constant and its tension is possibly also stable (the read values are contained within a possibly programmable set range for a possibly programmable set time).

If the system is integrated into the textile machine, the loop 15 if operating only for velocity control could obviously be activated and deactivated by an electric signal or a serial command present in the interfacing protocol.

Hence having activated this control loop to make uniform the yarn velocity at the value SETPOINT3_VELOCITY, the control unit 6 is limited to correcting (in accordance with known PID algorithms) the SETPOINT2_TENSION value by decreasing or increasing the tension, such that the yarn velocity consequently increases or decreases in order to make said velocity value uniform at the SETPOINT3_VELOCITY value.

This SETPOINT3_VELOCITY value can obviously be a fixed value (possibly programmable and/or a function of the machine operative state, in order for example to differentiate the velocity during the starting ramp from the actual processing velocity) or, in the case in which several different yarn feed devices are connected to a single control unit 6 (such as to define a feed system for a plurality of yarns of the machine T), be the resultant of the average of the velocities read by the unit associated with each sensor 7B cooperating with a corresponding yarn F (obviously each device has its own velocity sensor), or be different from position to position.

At the moment in which the unit 6 is about to close the control loop 15 to make the yarn velocity uniform, it continues to verify the set tension (SETPOINT2_TENSION) and the tension read by the sensor 7A, and if it realizes that the correction to be made is considerable and outside a possibly programmable range, and could hence cause yarn breakage because of excessive stretching or if it realizes that it is unable to compensate for the error, it generates an alarm or warning and indicates the irregularity to the textile machine or to the operator.

When in this completely automatic operating mode (tension and velocity control to decide processing mode), the device does not require any synchronization with the machine.

If the device is integrated into the machine and hence receives from it the collection rate value, from which to directly or indirectly obtain the value of the SETPOINT3_VELOCITY by suitable interfacing (serial line, encoder, proximity sensor, . . . ), the SETPOINT3_VELOCITY value could be determined in absolute manner for use in closing the second loop 15 and hence operate with constant stretch (ratio of machine absorption rate to yarn feed velocity).

In a third possible embodiment, the device combines the simplicity of constant tension feed with the benefits of constant velocity feed in a totally automatic manner.

Thus the device commences by operating in constant tension mode exactly as described in EP1901984, then while continuing to monitor the velocity of the individual yarns can decide to pass from constant tension mode to constant velocity mode, in order to make uniform not the tension in proximity to the machine T at the SETPOINT2_TENSION, but instead the velocity of said yarns at a SETPOINT3_VELOCITY.

This passage can take place automatically when the control unit 6 realizes that the velocity of the fed yarn or yarns is constant and its tension is also possibly stable (the read values are contained within a possibly programmable set range for a possibly programmable set time).

If the device is integrated into the textile machine, the velocity control could obviously be activated and deactivated by an electric signal or a serial command present in the interfacing protocol.

Hence after passage from constant tension mode to constant velocity mode the control unit 6 begins to close the second loop 15 not on the tension but on the velocity, to hence vary the tension set point (SETPOINT1_TENSION) of the feeder 4 such as to make the velocity in proximity to the machine T uniform at the prefixed SETPOINT3_VELOCITY; as already stated, this value can be a programmable fixed value self-leant during passage from constant tension to constant velocity. In a multiple yarn feed system comprising several devices of the aforesaid type, said prefixed value can be equal for all yarns or different from yarn to yarn in relation for example to the yarn type fed or to the process characteristics.

From the moment in which the device operates in constant velocity mode, the control unit 6 continues to monitor the pattern of the tension read by the sensor 7A of each position, and can decide to confirm the current operating mode (constant velocity) or to automatically pass to constant tension mode when for example it realizes that the tension read by each sensor 7A is varying and its variation is greater than a possibly programmable set range for a possibly programmable set time.

When in this completely automatic operating mode (tension and velocity control to decide processing mode), the device does not require any synchronization with the machine. In this respect the device operates in constant tension mode during machine start (starting ramp). When stable velocity is recognized it passes to constant velocity mode. As soon as it realizes that the tension read by the sensor 7A varies, it understands that the process velocity is changing and automatically passes to constant tension mode until the velocity is again stabilized.

If the device is integrated into the machine and hence receives from it the value of the collection rate, from which to directly or indirectly obtain the value of the SETPOINT3_VELOCITY by suitable interfacing (serial line, encoder, proximity sensor, . . . ), the SETPOINT3_VELOCITY value to be used to close the second loop 15 could be determined in absolute manner.

In a fourth possible embodiment of the device, the feed element 4 is applied not in proximity to the spools but in proximity to the process (hence replacing the sensor 7A) with the yarn unwinding from a usual spool creel.

Downstream of the bock 4 (which closes the first loop, to maintain tension constant at the prefixed value SETPOINT1_TENSION) there is only the velocity sensor 7B for measuring the friction values generated for example on the thread guides 8B positioned downstream. The control unit 6 compensates for these friction values by modifying the SETPOINT1_TENSION value of the feeder 4, to close the loop on velocity control, in order to make the velocity value at said SETPOINT3_VELOCITY uniform.

In this case the second tension sensor is not required, as it is not necessary to compensate for the friction values 8A, these being located upstream of the block 4 and hence being compensated together with the spool unwinding friction by the block 4 itself.

It is therefore evident that in all the aforedescribed possible embodiments the device is able to ensure compensation for the friction values 8A present between the first regulator loop (sensor 4D) operating on the spool unwinding point and the second regulator loop (where the sensor 7A is located).

The device is also able to indicate/compensate for the friction values downstream of the velocity sensor 7B. In this respect, a friction increase downstream of the sensor 7B results in yarn elongation and hence a decrease in its velocity/consumption, which can be indicated/compensated by a reduction in the feed tension upstream of the velocity sensor 7B. The same is obviously also valid in the opposite case of friction reduction upstream of the velocity sensor 7B, producing an increase in velocity/consumption, which can be indicated/compensated by increasing the feed tension upstream of the velocity sensor 7B.

All this ensures feed with constant velocity/quantity and differential tension in the first and in the second regulator loop, but with perfectly equal tension at the point in which yarn is effectively inserted into the textile process, hence downstream of possible variable friction values caused by gluing systems in sanitary napkin machines or thread guides in knitting machines.

The device of the invention, which operates in the aforesaid modes and hence by the aforeindicated method, also enables different degrees of alarm and pre-alarm to be provided: if the second sensor 7B were to sense a yarn velocity which is too different from the prefixed SETPOINT3_VELOCITY value and intervention of the unit 6 on the member 4 was unable to achieve a velocity value for the yarn F such as to satisfy said SETPOINT3_VELOCITY value, the unit 6 activates a pre-alarm device of known type (for example a visual and/or acoustic warning device) after a predetermined number of failed regulation attempts. This avoids the production of defective articles in that the invention allows intervention to solve the problem causing said yarn velocity variation due to something outside its control, such as incorrect passage of the yarn F downstream of the sensor 7B.

If a measuring device 9 is associated with the machine to measure the yarn absorption rate at the textile machine T (generally at the exit of the sensors 7B one or more entrainment rollers are present to which a proximity sensor can be connected), this value when suitably compensated (stretch ratio, i.e. ratio of machine collection rate to fed yarn velocity) can be used as the SETPOINT3_VELOCITY value for the control unit 6.

This is obviously obtained by connecting the measuring device 9 to the unit 6 to transfer the machine velocity datum to this latter; alternatively, the velocity datum could be fed to the unit 6 for example by a serial command provided in the communication protocol between the machine T and the control unit 6.

Additionally, by analyzing the velocities measured by the sensors 7B and knowing the machine velocity (measured by the measuring device 9 suitably connected to a machine rotary member or known in real time by receiving this information from the machine itself by means of a serial command provided in the communication protocol between the machine and the control unit), the unit 6 checks whether the stretch ratio lies within a set range (possibly programmable) and generates a warning or an alarm (halting the textile machine) if this value lies outside the range for a time greater than a (possibly programmable) prefixed value, for example to prevent yarn breakage (too much stretch).

The aforedescribed are obviously only examples of implementation of the invention. Other variants are possible: for example the unit 6 can be inserted into the member 4 or form part of an external control unit which governs the operation of the entire textile machine T.

In a further variant, during feed control at constant velocity the member 4 could also operate at constant velocity and not at constant tension. In this case, in order to make the yarn velocity uniform in proximity to the textile machine T the control unit 6 would vary the yarn feed velocity at the member 4 and not its reference tension.

A further variant could be provided by replacing a constant tension/velocity feeder operating in over-end takeoff (block 4) by a constant tension/velocity feeder operating in rolling takeoff.

These variants are also to be considered as falling within the scope of the ensuing claims.

The invention claimed is:

1. A method for feeding a yarn with constant tension and constant velocity or quantity, to a textile machine the yarn processing point of which is distant from a spool or equivalent support member from which the yarn unwinds, the method comprising tension regulator means and first tension measurement means being provided for said yarn measuring this tension and regulating this tension at a predetermined first value prefixed at the commencement of use of the machine, said regulator means and said first tension measurement means being connected to control means to define a first control and regulator loop for the feed of the yarn to the textile machine, velocity measurement means provided in proximity to the yarn processing point or zone of the textile machine and connected to said control means to define a second control loop (15) measuring and consequently controlling the velocity in proximity to said processing point or zone of the machine at which the yarn is processed, said velocity control and measurement by the second control loop being utilized to regulate the yarn feed tension or the fed yarn quantity via the first regulator loop to achieve a desired and prefixed velocity value for the yarn or for the quantity thereof fed at said processing point, with compensation of the friction values to which the yarn is subjected upstream and downstream of the velocity measurement means, wherein the yarn feed is controlled at constant tension, then passing to constant velocity feed control mode, during this constant velocity feed control mode the control means acting on the first predetermined tension value for the purpose of making the velocity value measured in proximity to the machine processing point or zone uniform at a prefixed value, said velocity control resulting in the measured value of this velocity being made uniform at the prefixed value.

2. A method as claimed in claim 1, wherein said desired and prefixed velocity value is either:

a) a value chosen and fixed at the commencement of use of the textile machine; or b) a value self-learnt by the control means after a stage in which the yarn feed passes from constant tension to constant velocity; or c) a value which is programmable and/or a function of the operative state of the textile machine.

3. A method as claimed in claim 1, wherein intervening on the tension of the fed yarn is independent of the operative state of the textile machine.

4. A method as claimed in claim 3, wherein the first tension measurement means continuously controls the first preset tension value, a warning signal being generated when the first tension measurement means senses the modification of said first tension value goes outside a preset and/or programmed range to prevent breakage of the yarn.

5. A method as claimed in claim 1, wherein the measurement of the yarn tension, regulation of the yarn tension, and the measurement of the fed yarn velocity are effected in proximity to the point or zone of the textile machine in which the fed yarn is processed.

6. A method as claimed in claim 1, wherein at the first tension measurement means, velocity measurement means are present forming part of the first control loop, second tension measurement means being provided at the velocity measurement means positioned in proximity to the yarn processing point or zone, these second tension measurement means being part of the second control loop, the velocity measurement means of said first loop defining first velocity measurement means and the velocity measurement means of said second loop defining said second velocity measurement means.

7. A method as claimed in claim 1, wherein the closed first control and regulator loop controlling the yarn feed to the processing zone of the textile machine is provided in proximity to the spool, the closed second control loop being based on velocity or quantity data of the fed yarn measured in proximity to said processing point or zone, said second control loop operating on the basis of a prefixed and/or programmable velocity value, the control means intervening whenever the measured velocity value is different from the prefixed value, said intervention generating a warning and/or error signal and possibly halting the textile machine whenever the velocity value measured in proximity to the machine does not remain at the prefixed and/or programmed value.

8. A method as claimed in claim 7, wherein before generating the warning and/or machine halt signal, the control means intervene on the tension regulator means by modifying the first predetermined tension value to modify the yarn velocity and make the yarn velocity uniform at the prefixed and/or programmable value.

9. A method as claimed in claim 1, wherein the velocity of the textile machine is measured corresponding to the rate of absorption of the yarn by said machine and compared with the yarn feed velocity to determine yarn stretch ratio.

10. A method as claimed in claim 9, comprising verifying said stretch ratio lies within a possibly programmable range of set values, a warning or alarm being generated if said ratio lies outside said range for a time greater than a possibly programmable prefixed time.

11. A method as claimed in claim 1, comprising not maintaining constant tension when the yarn control takes place at constant velocity.

12. A method as claimed in claim 1, comprising feeding a plurality of yarns to a textile machine, and calculating an average for the feed velocities of said yarns and identifying this average as the prefixed velocity value.

13. A device for feeding a yarn to a textile machine with constant tension and constant velocity or quantity, said yarn unwinding from a spool or equivalent support member, comprising:

tension regulator means and first tension measurement means for said fed yarn to measure this tension and regulate this tension at a first value predetermined at the commencement of use of the machine, said regulator means and said first measurement means connected to control means to define a first control and regulator loop for the feed of the yarn to the textile machine, means for measuring the velocity or quantity of fed yarn in proximity to the yarn processing point or zone of the textile machine and connected to said control means to define a second control loop to measure and consequently control the velocity or quantity of fed yarn in proximity to said zone or point of the machine, said control means, on the basis of the velocity measurement obtained by the second regulator loop, for regulating the feed tension of the yarn in proximity to the spool by operating on the regulator means via the first regulator loop to achieve a desired and prefixed velocity value for the yarn or for the quantity thereof fed at said processing point, wherein said device is arranged to implement the method of claim 1.

14. A device as claimed in claim 13, wherein the textile machine comprises velocity measurement means defining the absorption rate of the yarn by the machine, said control means receiving the data relative to the machine velocity and comparing the machine velocity with the feed rate of the yarn to identify a stretch ratio, said ratio being compared with a range of prefixed values, said control means generating an alarm if the ratio lies outside this range for a predefined time.

15. A system for feeding a plurality of yarns to a textile machine, each yarn being fed by a device for feeding the respective yarn to the textile machine with constant tension and constant velocity or quantity, each said yarn respectively unwinding from a spool or equivalent support member, said device comprising:

tension regulator means and first tension measurement means for said fed yarn to measure this tension and regulate this tension at a first value predetermined at the commencement of use of the machine, said regulator means and said first measurement means connected to control means to define a first control and regulator loop for the feed of the yarn to the textile machine, means for measuring the velocity or quantity of fed yarn in proximity to the yarn processing point or zone of the textile machine and connected to said control means to define a second control loop to measure and consequently control the velocity or quantity of fed yarn in proximity to said zone or point of the machine, said control means, on the basis of the velocity measurement obtained by the second regulator loop, regulating the feed tension of the yarn in proximity to the spool by operating on the regulator means via the first regulator loop to achieve a desired and prefixed velocity value for the yarn or for the quantity thereof fed at said processing point;

through a method in accordance with claim 1, wherein the prefixed velocity or quantity value of yarn is defined as the average of the feed velocities of these yarns calculated by a control unit which controls the implementation of each method and the operation of each device for the feed of each yarn fed to the textile machine.

* * * * *